US005874687A

United States Patent [19]

Kawamura

[11] Patent Number: 5,874,687

[45] Date of Patent: Feb. 23, 1999

[54] KEYBOARD INSTRUMENT HAVING HAMMER STOPPER OUTWARDLY EXTENDING FROM HAMMER SHANK AND METHOD OF REMODELING PIANO INTO THE KEYBOARD INSTRUMENT

[75] Inventor: Kiyoshi Kawamura, Hamamatsu, Japan

[73] Assignee: Yamaha Corporation, Hamamatsu, Japan

[21] Appl. No.: 318,979

[22] Filed: Oct. 6, 1994

Related U.S. Application Data

[63] Continuation-in-part of Ser. No. 160,606, Nov. 30, 1993, Pat. No. 5,386,083.

[51] Int. Cl.[6] ..... G10C 3/00; G10C 3/18

[52] U.S. Cl. ..... 84/719; 84/220; 84/236; 84/618

[58] Field of Search ..... 84/120, 171, 220, 84/615, 617, 719, 2, 3, 236

[56] References Cited

U.S. PATENT DOCUMENTS

| | | | |
|---|---|---|---|
| 4,704,931 | 11/1987 | Nagai et al. | 84/1.01 |
| 5,247,129 | 9/1993 | Nozaki et al. | 84/615 |
| 5,374,775 | 12/1994 | Kawamura et al. | 84/615 |
| 5,406,875 | 4/1995 | Tamai et al. | 84/433 |
| 5,428,186 | 6/1995 | Kaneko et al. | 84/719 |

OTHER PUBLICATIONS

Gulbransen Products Installation Manual, Jan. 29, 1993, p. 3.

*Primary Examiner*—William M. Shoop, Jr.
*Assistant Examiner*—Marlon T. Fletcher
*Attorney, Agent, or Firm*—Graham & James LLP

[57] ABSTRACT a stopper, a driver unit, key and pedal sensors, a sound processing unit and a sound system are installed in an acoustic piano so as to remodel the acoustic piano into a keyboard musical instrument performable with either acoustic or electronic sounds.

7 Claims, 12 Drawing Sheets

KEYBOARD INSTRUMENT HAVING HAMMER STOPPER OUTWARDLY EXTENDING FROM HAMMER SHANK AND METHOD OF REMODELING PIANO INTO THE KEYBOARD INSTRUMENT

This application is a continuation-in-part of U.S. patent application Ser. No. 08/160,606 which was filed on Nov. 30, 1993 now U.S. Pat. No. 538,6083.

FIELD OF THE INVENTION

This invention relates to a keyboard instrument and, more particularly, to a keyboard instrument selectively producing acoustic sounds and synthesized sounds.

DESCRIPTION OF THE RELATED ART

A piano gives a unique touch to a player, and an electronic keyboard synthesizer does not exactly imitate the unique key-touch, and an attempt was made on a compromise between a piano and an electronic synthesizer.

The compromise or the piano-like musical instrument has key action mechanisms coupled between the keyboard and the hammer assemblies and a tone generator system, and sounds are synthesized by the tone generator system. However, the key action mechanisms drive the hammer assemblies for striking the strings, and gives the unique key-touch to the player.

However, when a hammer strikes the strings, the strings vibrate, and produce an acoustic sound. The acoustic sound is mixed with the synthesized sound, and an audience feels the mixed sounds strange.

A muting mechanism incorporated in a grand piano is disclosed in Japanese Publication of Unexamined Utility Model Application (Kokai) No. 51-67732, and the muting mechanism restricts a hammer motion by means of a resilient member. According to the Japanese Publication of Unexamined Utility Model Application, the hammer concurrently strikes the resilient member and the associated strings, and the impact is split between the resilient member and the strings. As a result, the strings weakly vibrate, and the sound is lessened.

The prior art piano-like keyboard instruments can decrease the loudness of acoustic sounds. However, the prior art piano-like keyboard instruments can not perfectly eliminate the acoustic sounds from electrically synthesized sounds.

If the resilient member is moved to a closer position to the home position of the hammer, the hammer strikes the resilient member only, and the acoustic sound is not produced. However, the resilient member closer to the home position does not allow the jack to escape from the butt, and the key action mechanism can not give the unique key touch to the player.

If the hammer is removed, the strings never vibrate, and acoustic sounds are not mixed with the synthesized sounds. However, the keys are too light to give an appropriate resistance against the fingers of the player, and the key action mechanisms without hammers can not imitate the unique key-touch.

Thus, there is a trade-off between the acoustic sounds and the key-touch, and all of the prior art keyboard instruments do not satisfy players.

SUMMARY OF THE INVENTION

It is an important object of the present invention to provide a method of remodeling a piano into a keyboard instrument selectively entering into a mechanically sound producing mode and an electronically sound producing mode without acoustic sounds.

To accomplish the object, the present invention proposes to interrupt the rotation of a hammer before an associated hammer strikes strings.

In accordance with one aspect of the present invention, there is provided a method of remodeling a piano into a keyboard instrument having at least a mechanical sound producing mode and an electronic sound producing mode, comprising the steps of: a) preparing a piano which comprises a keyboard having a plurality of keys turnable with respect to a stationary board member, the plurality of keys being selectively depressed by a player, a plurality of key action mechanisms functionally connected to the plurality of keys, respectively, and selectively actuated by the associated keys when the player depresses the associated keys, a plurality of hammer mechanisms respectively associated with the plurality of key action mechanisms, and selectively driven for rotation by the actuated key action mechanisms, and a plurality of sets of strings respectively associated with the plurality of hammer mechanisms, and selectively struck by the associated hammer mechanisms driven by the actuated key action mechanisms for producing acoustic sounds; and b) adding an electronic sound producing means and a controlling means to the piano, the electronic sound producing means being operative to decide what keys are depressed by the player in the electronic sound producing mode for electronically producing sounds corresponding to the keys depressed by the player, the controlling means having a stopper changeable between a free position and a blocking position, and a driver unit responsive to an instruction of the player for changing the stopper between the free position in the mechanically sound producing mode and the blocking position in the electronic sound producing mode, the stopper in the free position allowing the hammer mechanism driven for rotation to strike the associated sets of strings, the stopper in the blocking position causing the hammer mechanisms drive for rotation to return to initial positions thereof without striking the associated sets of strings.

In accordance with another aspect of the present invention, there is provided a stopper mechanism used for remodeling a piano into a keyboard musical instrument having a least at mechanical sound producing mode and an electronic sound producing mode, comprising; supporting members attached to members of the piano; a stopper movably supported by the supporting members, and installed inside of the piano; and a driving unit responsive to an instruction of a player for changing the stopper between a free position in said mechanical sound producing mode and a blocking position in the electronic sound producing mode, the stopper in the free position allowing hammers of the piano to strike associated sets of strings of the piano, the stopper in the blocking position causing the hammers to return to initial positions thereof without striking the associated sets of strings.

In accordance with yet another aspect of the present invention, there is provided an electronic sound producing system used for remodeling a piano into a keyboard musical instrument having at least a mechanical sound producing mode and an electronic sound producing mode, comprising; a plurality of sensors operative to detect keys of the piano when a player depresses the keys; a sound processing subsystem connected to the plurality of sensors, and operative to produce audio signals for generating sounds having respectively notes identical with the notes assigned to the keys; and a sound sub-system connected to the sound processing sub-system, and operative to produce the sounds instead of piano sound produced through vibrations of strings of the piano.

BRIEF DESCRIPTION OF THE DRAWINGS

The features and advantages of the keyboard instrument and the method according to the present invention will be more clearly understood from the following description taken in conjunction with the accompanying drawings in which.

DESCRIPTION OF THE PREFERRED EMBODIMENTS

First Embodiment

Figure 1:
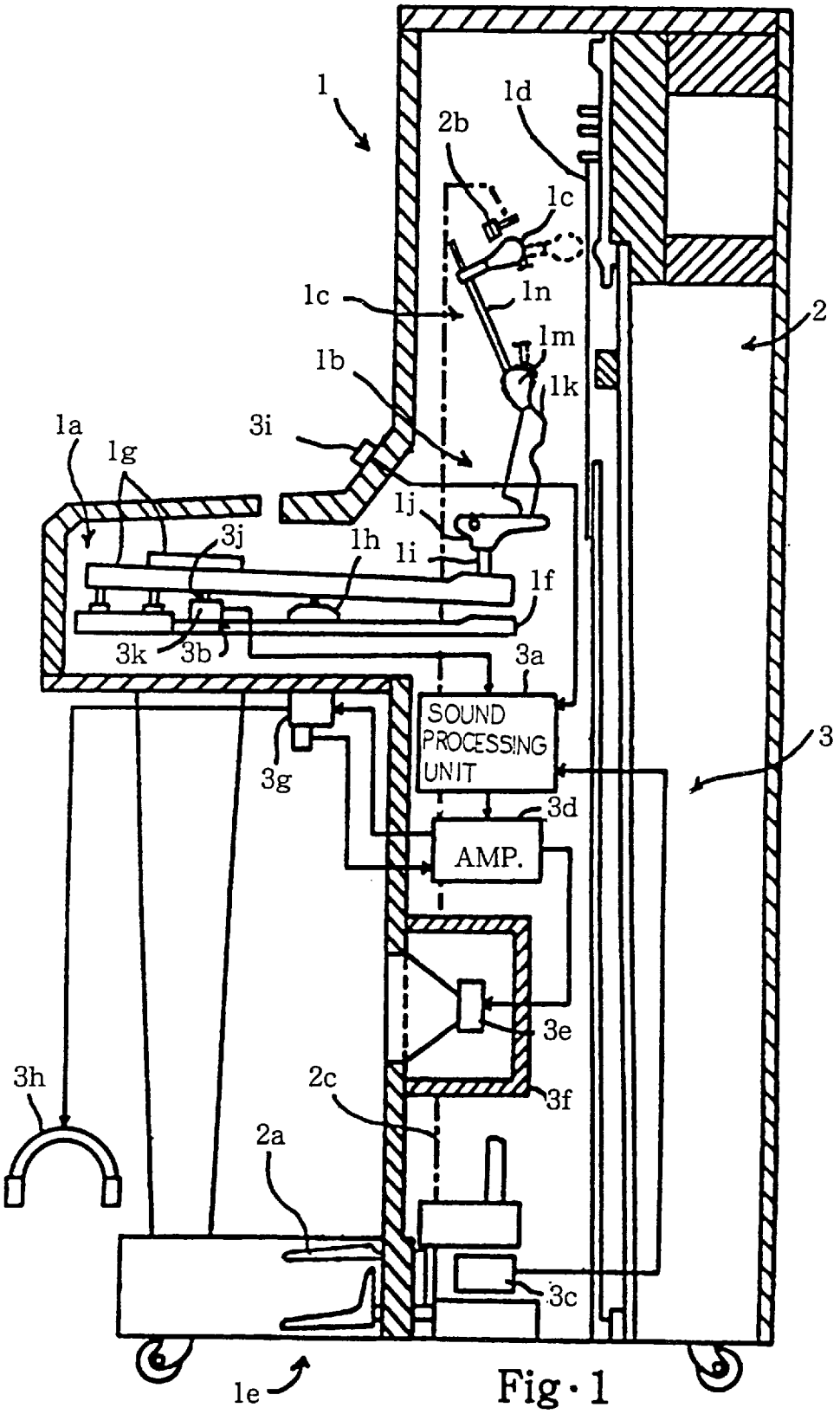
FIG. 1 is a side view showing the structure of a keyboard instrument according to the present invention.
Figure 2:
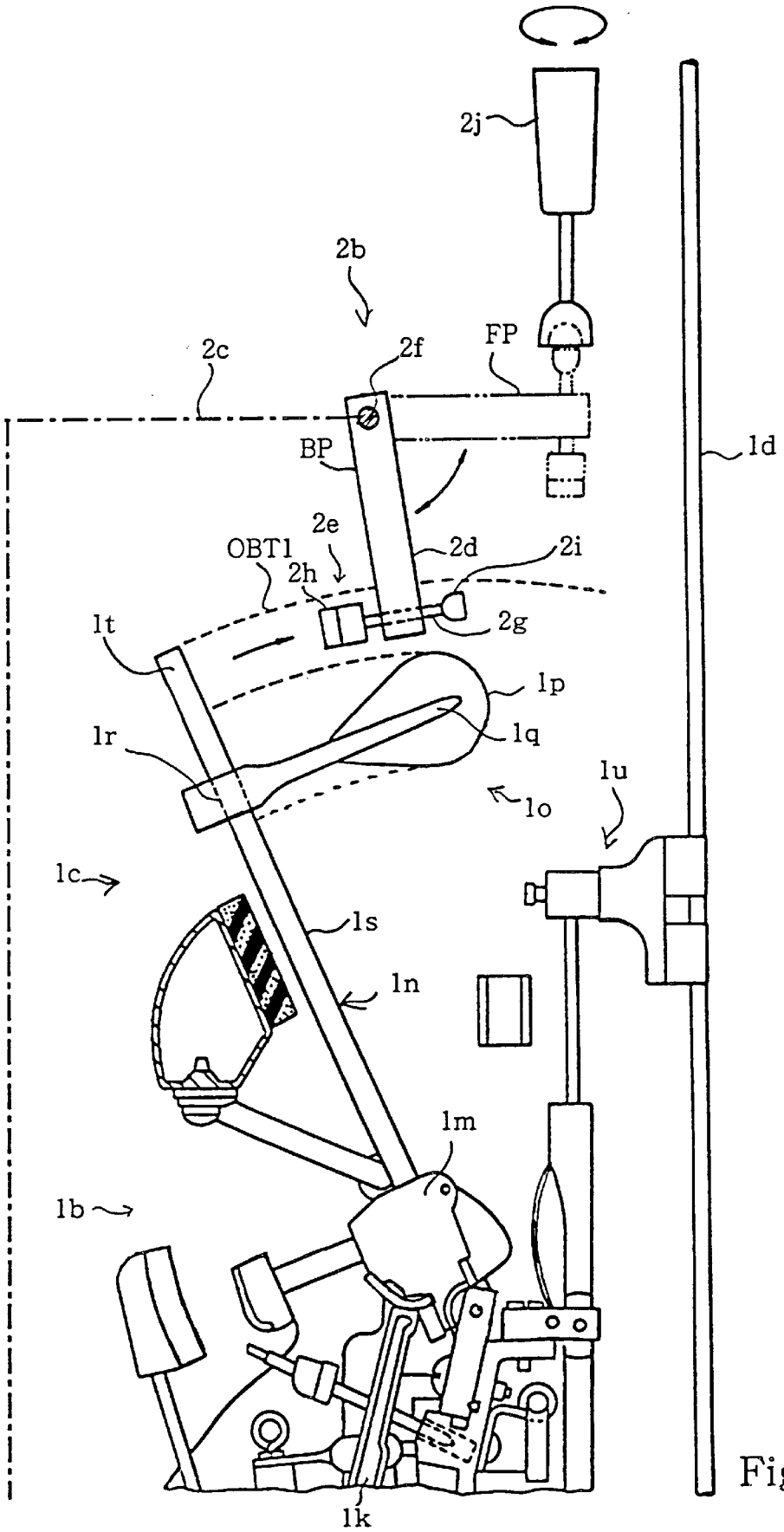
FIG. 2 is a side view showing a hammer stopper associated with a hammer mechanism incorporated in the keyboard instrument.

Referring first to FIGS. 1 and 2 of the drawings, a keyboard instrument embodying the present invention largely comprises an acoustic piano 1, a silent system 2 and an electronic sound generating system 3, and selectively enters a mechanical sound producing mode and an electronic sound producing mode. In this instance, the silent system serves as a controlling means.

While staying in the mechanical sound producing mode, the keyboard instrument serves as an acoustic upright piano, and not only the sounds but also the key-touch are identical with those of the acoustic upright piano. On the other hand, the keyboard instrument electrically synthesizes sounds in response to keying-in, and the acoustic sounds are not produced in the electronic sound producing mode. In this instance, the acoustic piano 1 is of the upright type. However, the acoustic piano 1 may be of a grand type.

The acoustic piano 1 comprises a keyboard 1*a*, a plurality of key action mechanisms 1*b*, a plurality of hammer mechanisms 1*c*, a plurality sets of strings 1*d* and a pedal mechanism 1*e*. The keyboard 1*a* is mounted on a key bed 1*f*, and is implemented by black and white keys 1*g*. In this instance, the key bed 1*f* serves as a stationary board member. The black and white keys 1*g* are turnable with respect to balance pins embedded in a balance rail 1*h*. The key action mechanisms 1*b* are respectively linked with the rear ends of the black and white keys 1*g*, and drive the hammer mechanisms 1*c* for rotation when the associated keys 1*g* are depressed.

Each of the key action mechanisms 1*b* comprises a capstan button 1*i* projecting from the rear end of the associated key, a whippen 1*j* held in contact with the capstan button 1*i* and a jack 1*k* provided on the whippen 1*j*, and the jack 1*k* exerts a force on the associated hammer mechanism for rotation.

Each of the hammer mechanisms 1*c* comprises a butt 1*m* kicked by the jack 1*k*, a hammer shank 1*n* implanted in the butt 1*m* and a hammer head 1*o* coupled with the leading end of the hammer shank 1*n*. The hammer shank 1*n* is formed of maple or the like, and the hammer head 1*o* is implemented by a hammer felt 1*p* attached to a hammer wood 1*q*. A hole 1*r* is formed in a boss portion of the hammer wood 1*q*, and the hammer shank 1*n* passes through the hole 1*r* in such a manner as to be substantially normal with respect to the hammer head 1*o*. The portion of the hammer shank 1*n* between the butt 1*m* and the hammer wood 1*q* is referred to a hammer shank portion 1*s* corresponding to a hammer shank of an upright piano, and the portion projecting from the hammer wood 1*q* is called as an extension 1*t*.

When the jack 1*k* kicks the butt 1*m*, the butt 1*m* and, accordingly, the hammer head 1*o* are driven for rotation toward the associated strings 1*d*, and the hammer head 1*o* strikes the strings 1*d* so that the strings 1*d* vibrate for producing an acoustic sound.

The pedal mechanism 1*e* usually has three pedals and three pedal link sub-mechanisms respectively associated with the pedals. One of the pedals is called as a damper pedal, and allows the strings 1*d* to prolong the sound. The second pedal is called as a soft pedal, and causes the hammer heads 1*o* to strike fewer than the normal number of strings for lessening the volume. The last pedal is called as a sostenuto pedal, and enables selected notes to be sustained independently from the others.

A damper mechanism 1*u* is associated with each set of strings 1*d*, and is left from the set of strings 1*d* before an impact of the hammer head 1*o*.

The key action mechanisms 1*b*, the hammer mechanisms 1*c*, the damper mechanisms 1*u* and the pedal mechanism 1*e* are analogous to those of an upright piano, and are well known to a person skilled in the art. For this reason, no further description is incorporated hereinbelow for the sake of simplicity.

The silent system 2 comprises a pedal 2*a*, a rotatable stopper 2*b*, a link mechanism 1*c* and the plurality of extensions 1t. The pedal 2*a* is manipulated by a player, and is shifted between a rest position and a depressed position.

Though not shown in the drawings, a step portion is formed in a lower front board, and the pedal 2*a* is caught by the step portion so as to maintain the pedal 2*a* at the depressed position. While the pedal 2*a* is in the rest position, the rotatable stopper 2*b* is out of an orbit OBT1 of the extensions 1*t*, and is kept in a free position FP. For this reason, the hammer heads 1*o* strike the sets of strings 1*d* without any interruption of the rotatable stopper 2*b*, and the player performs a music in the mechanical sound producing mode.

On the other hand, if the player steps on the pedal 2*a*, the pedal 2*a* is shifted from the rest position to the depressed position, and the rotatable stopper 2*b* is moved into the orbit OBT1 of the extension. However, the rotatable stopper 2*b* is still out of an orbit OBT2 of the hammer heads 1*o*. If the player depresses one of the keys 1*g*, the extension 1*t* is brought into contact with the rotatable stopper 2*b* thus entering into a blocking position BP after the escape of the jack 1*k*, and rebounds on the rotatable stopper 2*b* before an impact of the hammer head 1*o*.

The rotatable stopper 2*b* comprises a stopper rail 2*d* shared between all of the hammer mechanisms 1*c*, a plurality of stoppers 2*e* respectively associated with the hammer mechanisms 1*c* and a rod member 2*f*. The rod member 2*f* is connected with the link mechanism 2*c*, and is driven for rotation together with the stopper rail 2*d*. The stopper 2*e* is analogous to a regulating button, and comprises a screw member 2*g* and a cushion member 2*h* attached to a head of the screw member 2*g*. The cushion member 2*h* is formed of felt or leather, and absorbs the impact of the extension 1*t*.

A male screw is formed on the outer surface of the screw member 2*g*, and is engaged with a female screw formed in the stopper rail 2*d*. A suitable coupling 2*i* is connected with the screw member 2*g*, and the screw member 2*g* and the cushion member 2*h* are turnable with a tool 2*j* inserted into the coupling 2*i*.

A tuner regulates distances between the cushion members 2*h* and the associated extensions with the tool 2*j*, and the distances are adjusted in such a manner that the jacks 1*k* escape from the associated butts 1*m* and that the extensions 1*t* rebound on the cushion members 2*h* before impacts of the associated hammer heads 1*o* at the strings 1*d*. For this reason, the key action mechanisms give the piano key-touch to the player in the electronically sound producing mode without acoustic sound, and the distances are not less than the distances between the toes of the jacks 1*k* and the regulating buttons (not shown). The distances between the toes and the regulating buttons are about 3 millimeters for low-pitched tones, 2.5 millimeters for middle pitched tones and 2 millimeters for high pitched tones.

Turning back to FIG. 1, the electronic sound generating system 3 comprises a sound processing unit 3*a*, a plurality of key sensors 3*b*, a plurality of pedal sensors 3*c*, an amplifier unit 3*d*, a speaker system 3*e* housed in a speaker box 3*f*, a socket unit 3*g*, a headphone 3*h* detachable from the socket unit 3*g* and a switch unit 3*i*, and is activated in the electronic sound producing mode through the switch unit 3*i*.

The plurality of key sensors 3*b* are respectively associated with the keys 1*g*, and each of the key sensors 3*b* comprises a shutter plate 3*j* fixed to the bottom surface of the associated key and a photo-interrupter 3*k* monitoring the shutter plate 3*j*. Four different patterns are formed in the shutter plate 3*j*, and the four patterns sequentially pass through an optical path produced by the photo interrupter 3*k* when the associated key is depressed. Time intervals between the four patterns are reported from the photo interrupter 3*k* to the sound processing unit 3*a*, and the sound processing unit 3*a* determines the key velocity and estimates the time when the associated hammer head 1*o* strikes the strings 1*d*.

The pedal sensors 3*c* monitor the three pedals to see whether or not the player steps on the three pedals. If the player steps on one of the pedals, the associated pedal sensor 3*c* detects the motion of the pedal, and report the depressed pedal to the sound processing unit 3*a*.

The sound processing unit 3*a* sequentially scans input ports assigned to the switch unit 3*i*, the key sensors 3*b* and the pedal sensors 3*c* in the electronic sound producing mode. If the switch unit 3*i* is manipulated again, the keyboard instrument returns to the mechanical sound producing mode, and the sound processing unit 3*a* does not produce analog sound signals from sets of pcm (Pulse Code modulation) data codes.

On the other hand, the sound processing unit 3*a* is responsive to detecting signals from the key sensors 3*b* and the pedal sensors 3*c* for producing the analog sound signals. If one of the keys 1*g* is depressed by the player, the key sensor 3*b* supplies the detecting signal indicative of the key motion, and a set of pcm data are fetched for data processing. An analog sound signal is produced from the pcm data codes, and is supplied to the amplifier unit 3*d*. The amplifier unit 3*d* drives the speaker system 3*e* or the headphone 3*h*.

The arrangement of the sound processing unit 3*a* is disclosed in U.S. Ser. No. 08/073,092 filed on Jun. 7, 1993, and no further description is incorporated hereinbelow for the sake of simplicity.

Assuming now that a player starts fingering on the keyboard 1*a* in the mechanical sound producing mode, the player depresses one of the keys in the performance, and the capstan button 1*i* pushes up the whippen 1*j*. The whippen 1*j* allows the jack 1 to rotate the butt 1*m* and the hammer mechanism 1*c* in the clockwise direction in FIG. 2; however, the regulating button restricts the motion of the jack 1*k*, and the whippen 1*j* compresses a jack spring. When the jack spring is sufficiently compressed, the resilient force accumulated in the jack spring allows the jack 1*k* to escape from the butt 1*m*, and the jack 1*k* kicks the butt 1*m* for rotating in the clockwise direction at high speed. The pedal 2*a* remains in the rest position, and the link mechanism 2*c* keeps the rotatable stopper 2*b* out of the orbit OBT1. For this reason, the hammer head 1*o* reaches the set of strings 1*d*, and rebounds thereon. The strings 1*d* vibrates, and the acoustic sound is produced.

The hammer head 1*o* rotates in the counter clockwise direction, and the key released from the end position allows a catcher to be brought into contact with a back check. Then, the key action mechanism 1*b* and the hammer mechanism 1*c* return to the respective home positions.

On the other hand, if the player steps on the pedal 2*a*, the link mechanism 2*c* rotates the stopper rail 2*d* in the clockwise direction, and the stoppers 2*e* enter the blocking position. If the player depresses the key 1*g*, the capstan button 1*i* pushes up the whippen 1*j*, and the jack 1*k* rotates the butt 1*m* in the clockwise direction. When the toe is brought into contact with the regulating button, the whippen 1*j* compresses the jack spring, and jack spring causes the jack 1*k* to escape from the butt 1*m*. As a result, the key action mechanism 1*b* gives the piano key touch to the player.

After the escape, the butt 1*m* and the hammer head 1*o* turns toward the set of strings 1*d*. However, extension 1*t* is brought into contact with the stopper 2*e* on the way to the strings 1*d*, and rebounds on the stopper 2*e* without strike at the strings 1*d*. The key released from the end position allows the back check to be brought into contact with the catcher, and the key action mechanism 1*b* and the hammer mechanism 1*c* return to the respective home positions.

As will be appreciated from the foregoing description, the rotatable stopper 2*b* is moved into and out of the orbit of the extension 1*t*, and allows a player to perform a music in the mechanical sound producing mode or the electronic sound producing mode without sacrifice of the piano key-touch.

Second Embodiment

Figure 3:
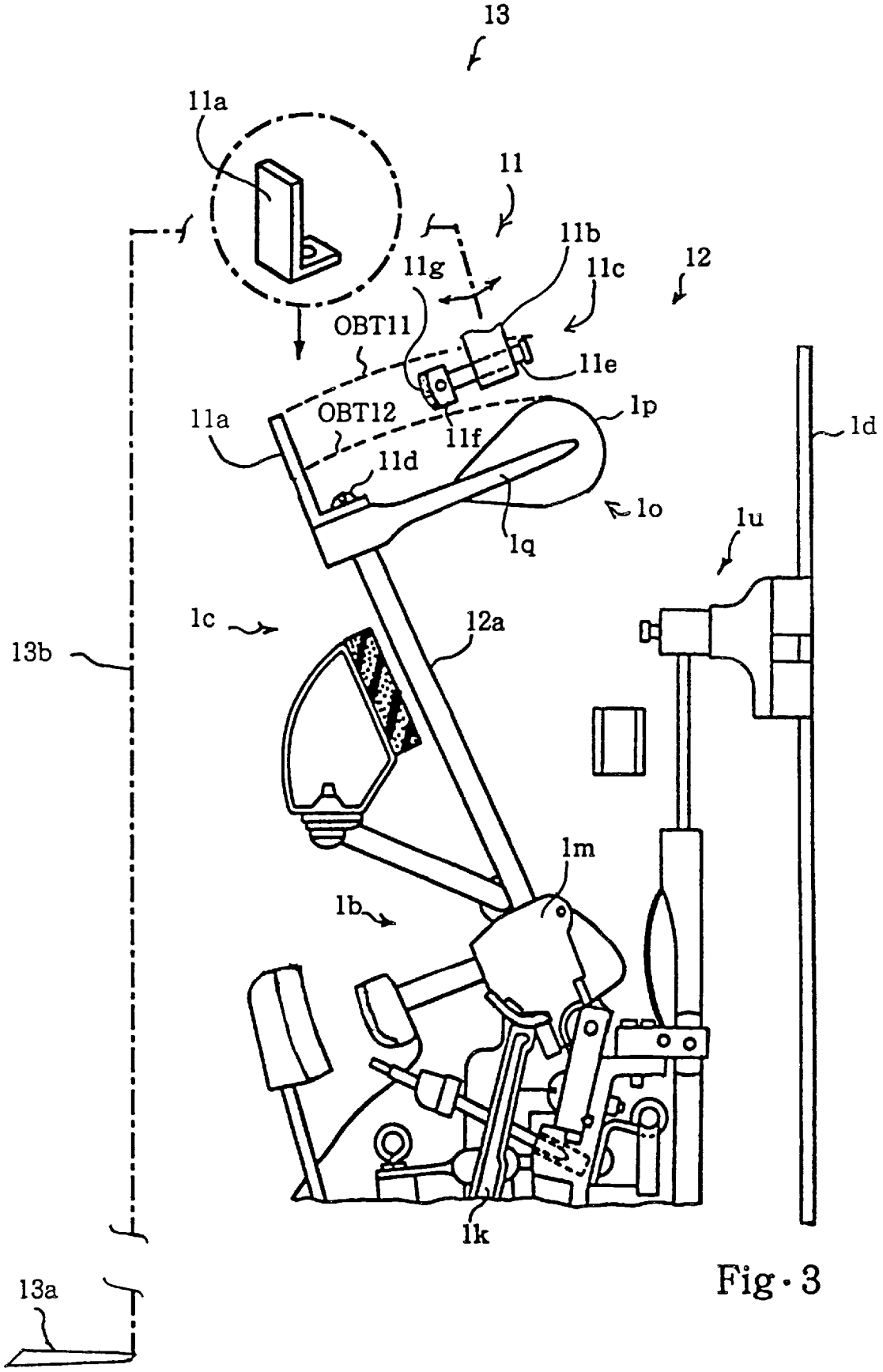
FIG. 3 is a side view showing a hammer stopper incorporated in another keyboard instrument according to the present invention.

Turning to FIG. 3 of the drawings, a hammer stopper 11 is incorporated in another keyboard instrument embodying the present invention. The keyboard instrument implementing the second embodiment largely comprises an acoustic piano 12, a silent system 13 and an electronic sound generating system (not shown), and selectively enters into a mechanical sound producing mode and an electronic sound producing mode.

The acoustic piano 12 is of the upright type, and is similar to the acoustic piano 1 except for hammer shanks 12*a*. For this reason, the other component parts are labeled with the references designating the corresponding parts of the acoustic piano 1 without detailed description. In this instance, the hammer shanks 12*a* are inserted into the hammer woods 1*q*, and are fixed thereto.

The electronic sound generating system is similar to that of the first embodiment, and no further description is incorporated hereinbelow for the sake of simplicity.

The silent system 13 largely comprises a pedal 13*a*, a link mechanism 13*b* and the hammer stopper 11. The pedal 13*a* is manipulated by a player, and is caught by a step portion of a board (not shown) incorporated in the acoustic piano 12 for keeping at manipulated state. The link mechanism 13*b* is connected between the pedal 13*a* and the hammer stopper 11, and causes the hammer stopper 11 to change the position.

Namely, while the pedal 13*a* is in the manipulated state, the link mechanism 13*b* changes the hammer stopper 11 from a free position to a blocking position, and the hammer stopper 11 blocks the strings from the hammer heads 1*o* as will be described in detail below.

On the other hand, when the pedal 13*a* is released from the manipulated position, the link mechanism 13*b* allows the hammer stopper 11 to return from the blocking position to the free position, and the hammer heads 1*o* strike the associated strings 1*d* without interruption of the hammer stopper 11.

The hammer stopper 11 comprises a plurality of detachable bracket members 11*a* bolted to the hammer woods 1*q*, a stopper rail 11*b* connected with the link mechanism 13*b* and a plurality of stoppers 11*c* supported by the stopper rail 11*b*. If the leading ends of the hammer shanks 12*a* are exposed to the upper surfaces of the hammer woods 1*q*, the bracket members 11*a* may be bolted to the leading ends of the hammer shanks 12*a*.

The detachable bracket members 11*a* are shaped into a generally L-shape configuration, and bolts 11*d* fix the detachable bracket members 11*a* to the hammer woods 1*q*. For this reason, the detachable bracket members 11*a* radially outwardly project from the hammer woods 1*q* and respectively trace orbits OBT11 while the hammer heads 1*o* rotate toward the strings 1*d* along the orbits OBT12. There is the blocking position of the hammer stopper 11 between the orbits OBT12 of the hammer heads 1*o* and the orbits OBT11 of the detachable bracket members 11*a*. On the other hand, the free position of the hammer stopper 11 is out of the orbits OBT11, and not only the hammer mechanisms 1*c* but also the detachable bracket members 11*a* are not brought into contact with the stoppers 11*c*.

Each of the stoppers 11*c* comprise a threaded stem portion 11*e* engaged with a female screw formed in the stopper rail 11*b*, a head portion 11*f* integral with the threaded stem portion 11*e* and a cushion member 11*g* attached to the head portion 11*f*. The treaded stem portion 11*e* is turnable by means of a tool (not shown), and the distance between the detachable bracket members 11*a* and the cushion members 11*g* are regulated to predetermined values as similar manner to the first embodiment. In this instance, the silent system 11 serves as a controlling system, and the detachable bracket members 11*a* as extensions.

The behavior of the keyboard instrument implementing the second embodiment is similar in both mechanical and electronic sound producing modes to the first embodiment, and description on the behavior is omitted for avoiding repetition.

Description is hereinbelow made on a method of remodeling an upright piano into the keyboard instrument according to the present invention. The upright piano is similar to that of the acoustic piano 12, and the keyboard 1*a*, the key action mechanisms 1*b*, the hammer mechanisms 1*c*, the sets of strings 1*d*, the pedal mechanism 1*e* and the damper mechanisms 1*u* are incorporated therein. The hammer shanks 12*a* form parts of the hammer mechanisms 1*c* instead of the hammer shanks 1*n*, and are standard parts of the upright piano.

The remodeling method starts with preparation of the silent system 13 and the electronic sound producing system, and the silent system 13 and the sound processing system are added to the upright piano. Namely, the sound processing unit 3*a*, the amplifier unit 3*d*, the speaker system 3*e* housed in the speaker box 3*f* and the link mechanism 13*b* are installed in vacant space inside the upright piano, and the socket unit 3*g* and the switch unit 3*i* are attached to suitable board members of the upright piano. The switch unit 3*i* may be linked with the link mechanism 13*b*, and is automatically manipulated by the player together with the pedal 13*a*.

The detachable bracket members 11*a* are respectively bolted to the hammer woods 11*q*, and the stopper rail 11*b* is connected with the link mechanism 13*b*. The stoppers 11*c* have been already screwed in the stopper rail 11*b* at spacings, and, for this reason, are installed together with the stopper rail 11*b*. A tuner regulates distances between the bracket members 11*a* and the cushion members 11*g* to the predetermined values, and the remodeling is completed.

Thus, any component part of an upright piano is not changed, and the silent system 11 is desirable for the remodeling.

Third Embodiment

Figure 4:
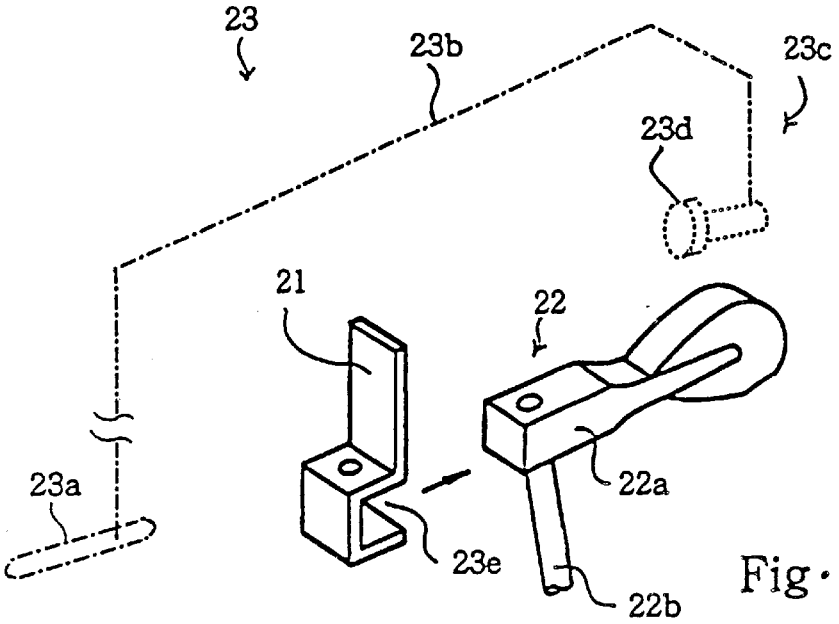
FIG. 4 is a perspective view showing disassembled state of a detachable bracket member incorporated in yet another keyboard instrument according to the present invention.

Turning to FIG. 4 of the drawings, a detachable bracket member 21 is separated from a hammer head incorporated in yet another keyboard instrument embodying the present invention. The keyboard instrument implementing the third embodiment largely comprises an acoustic piano, a silent system 23 and an electronic sound generating system (not shown), and selectively enters into a mechanical sound producing mode and an electronic sound producing mode.

The acoustic piano and the electronic sound generating system are similar to those of the second embodiment, and no further description is incorporated hereinbelow for the sake of simplicity.

The silent system 23 largely comprises a pedal 23*a*, a link mechanism 23*b* and a hammer stopper 23*c*. The pedal 23*a* is manipulated by a player, and is caught by a suitable retainer on a board member incorporated in the acoustic piano for keeping at manipulated state. The link mechanism 23*b* is connected between the pedal 23*a* and the hammer stopper 23*c*, and causes the hammer stopper 23*c* to change the position.

Namely, while the pedal 23*a* is in the manipulated state, the link mechanism 23*b* changes the hammer stopper 23*c* from a free position to a blocking position, and the hammer stopper 23*c* blocks the strings from the hammer heads as will be described in detail below.

On the other hand, when the pedal 23*a* is released from the manipulated position, the link mechanism 23*b* allows the hammer stopper 23*c* to return from the blocking position to the free position, and the hammer heads strike the associated strings without interruption of the hammer stopper 23*c*.

The hammer stopper 23*c* has a plurality of detachable bracket members 21 bolted to hammer woods 22*a* and a plurality of stoppers 23*d* driven by the link mechanism 23*b*. Each of the detachable bracket members 21 is bent at the right angle three times for forming a pocket portion 23*e*, and the hammer wood 22*a* is snugly received into the pocket portion 23*e*. As a result, the detachable bracket member 21 radially outwardly projects from the hammer wood 22*a*.

Figure 5:
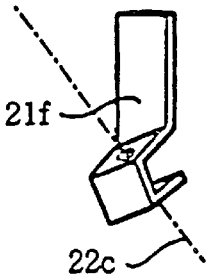
FIG. 5 is a perspective view showing a detachable bracket member for a hammer mechanism assigned a low-pitched tone.

The hammer shanks 22*b* assigned low-pitched tones are usually oblique, and the detachable bracket members 21 for the low-pitched tones decline with respect to the center axis 22*c* of the leading end portions of the hammer shanks 22*b* as shown in FIG. 5.

Figure 6:
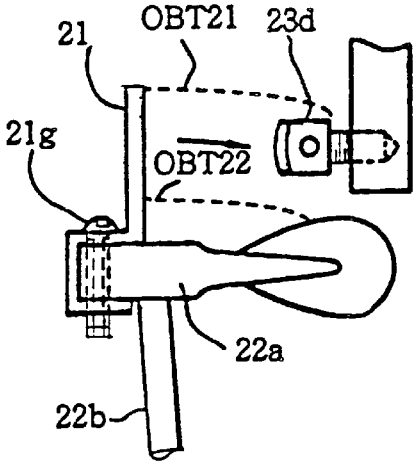
FIG. 6 is a side view showing the detachable bracket member assembled with the hammer mechanism.

Bolts 21*g* fix the detachable bracket members 21 to the hammer woods 22*a* as shown in FIG. 6, and the detachable bracket members 21 rotate together with the hammer woods 22*a*. The leading ends of the detachable bracket members 21 respectively trace orbits OBT21 while the hammer heads 22 rotate toward the strings along the orbits OBT22.

The blocking position of the hammer stopper 23 is between the orbits OBT22 of the hammer heads 22 and the orbits OBT21 of the detachable bracket members 21. On the other hand, the free position is out of the orbits OBT21, and not only the hammer heads 22 but also the detachable bracket members 21 are not brought into contact with the stoppers 23*d* in the free position.

The behavior of the keyboard instrument implementing the third embodiment is similar in both mechanical and electronic sound producing modes to the first and second embodiments, and an upright piano is remodeled to the keyboard instrument implementing the third embodiment through the method described in connection with the second embodiment. Since the bolts 2l*g* are turnable by an operator on the keyboard side, the remodeling work is easier than that of the second embodiment.

Fourth Embodiment

Figure 7:
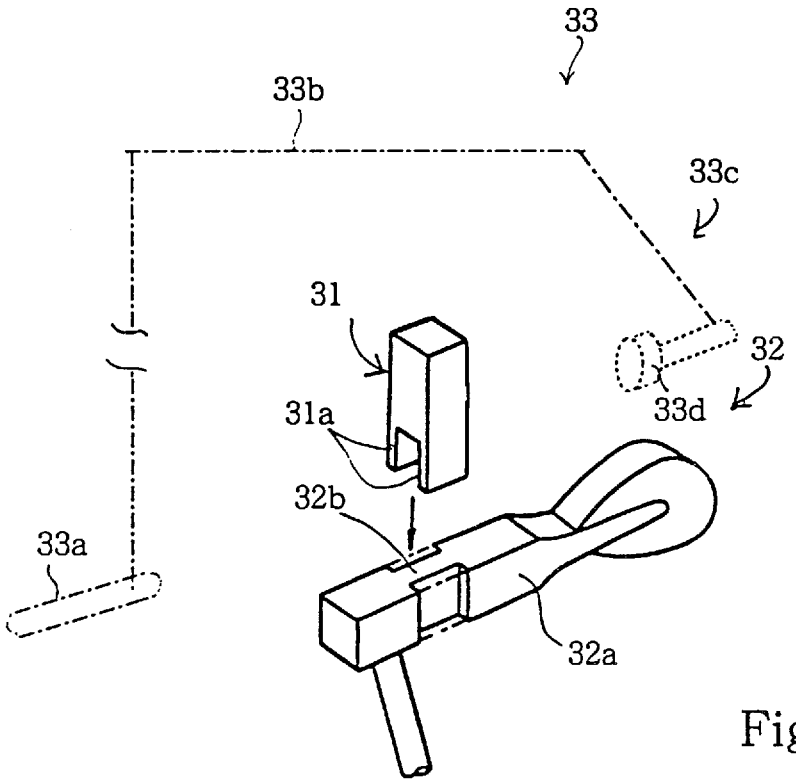
FIG. 7 is a perspective view showing a detachable bracket member separated from a hammer wood incorporated in still another keyboard instrument according to the present invention.

Turning to FIG. 7 of the drawings, a detachable bracket member 31 is separated from a hammer head 32 incorporated in still another keyboard instrument embodying the present invention. The keyboard instrument implementing the fourth embodiment largely comprises an acoustic piano, a silent system 33 and an electronic sound generating system (not shown), and selectively enters into a mechanical sound producing mode and an electronic sound producing mode.

The acoustic piano and the electronic sound generating system are similar to those of the second embodiment, and no further description is incorporated hereinbelow for the sake of simplicity.

The silent system 33 largely comprises a pedal 33*a*, a link mechanism 33*b* and a hammer stopper 33*c*. The pedal 33*a* is manipulated by a player, and is caught by a suitable retainer on a board member incorporated in the acoustic piano for keeping it at manipulated state. The link mechanism 33*b* is connected between the pedal 33*a* and the hammer stopper 33*c*, and causes the hammer stopper 33*c* to change the position.

Namely, while the pedal 33*a* is in the manipulated state, the link mechanism 33*b* changes the hammer stopper 33*c* from a free position to a blocking position, and the hammer stopper 33*c* blocks the strings from the hammer heads 32 as will be described in detail below.

On the other hand, when the pedal 33*a* is released from the manipulated position, the link mechanism 33*b* allows the hammer stopper 33*c* to return from the blocking position to the free position, and the hammer heads 32 strike the associated strings without interruption of the hammer stopper 33*c*.

The hammer stopper 23*c* has a plurality of detachable bracket members 31 bolted to hammer woods 32*a* and a plurality of stoppers 33*d* driven by the link mechanism 33*b*. Each of the detachable bracket members 31 has a bifurcated lower end portion 31*a*, and the hammer wood 22*a* is partially narrowed. The narrow portion 32*b* is snugly received into the bifurcated lower end portion 31*a*, and the detachable bracket member 31 radially outwardly projects from the hammer wood 32*a*. The detachable bracket member 31 is fixed to the hammer wood 32*a* without any screw, and rotates together therewith.

Figure 8:
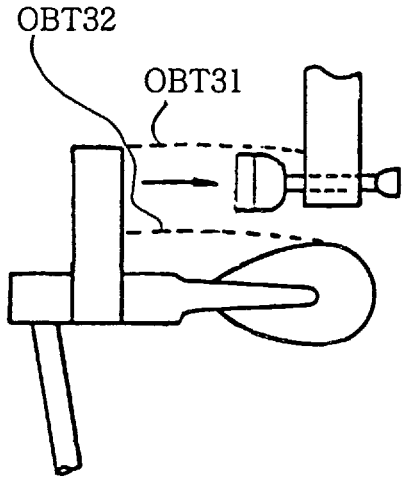
FIG. 8 is a side view showing the bracket member attached to the hammer wood.

The leading ends of the detachable bracket members 31 respectively trace orbits OBT31 while the hammer heads 3 rotate toward the strings along the orbits OBT32 as shown in FIG. 8. The blocking position of the hammer stopper 33*c* is between the orbits OBT32 of the hammer heads 32 and the orbits OBT31 of the detachable bracket members 31. On the other hand, the free position is out of the orbits OBT31, and not only the hammer heads 32 but also the detachable bracket members 31 are not brought into contact with the stoppers 33*d* in the free position.

The behavior of the keyboard instrument implementing the third embodiment is similar in both mechanical and electronic sound producing modes to the first and second embodiments, and an upright piano is remodeled to the keyboard instrument implementing the fourth embodiment through a method similar to the second embodiment. In the remodeling method, the hammer woods 32*a* are partially cut away for forming the narrow portion 32*b*, and the detachable bracket members 31 are fixed to the hammer woods 32*a*. Although the hammer woods 32*a* of an upright piano are machined, any screw is not required for the detachable bracket members 31.

Fifth Embodiment

Figure 9:
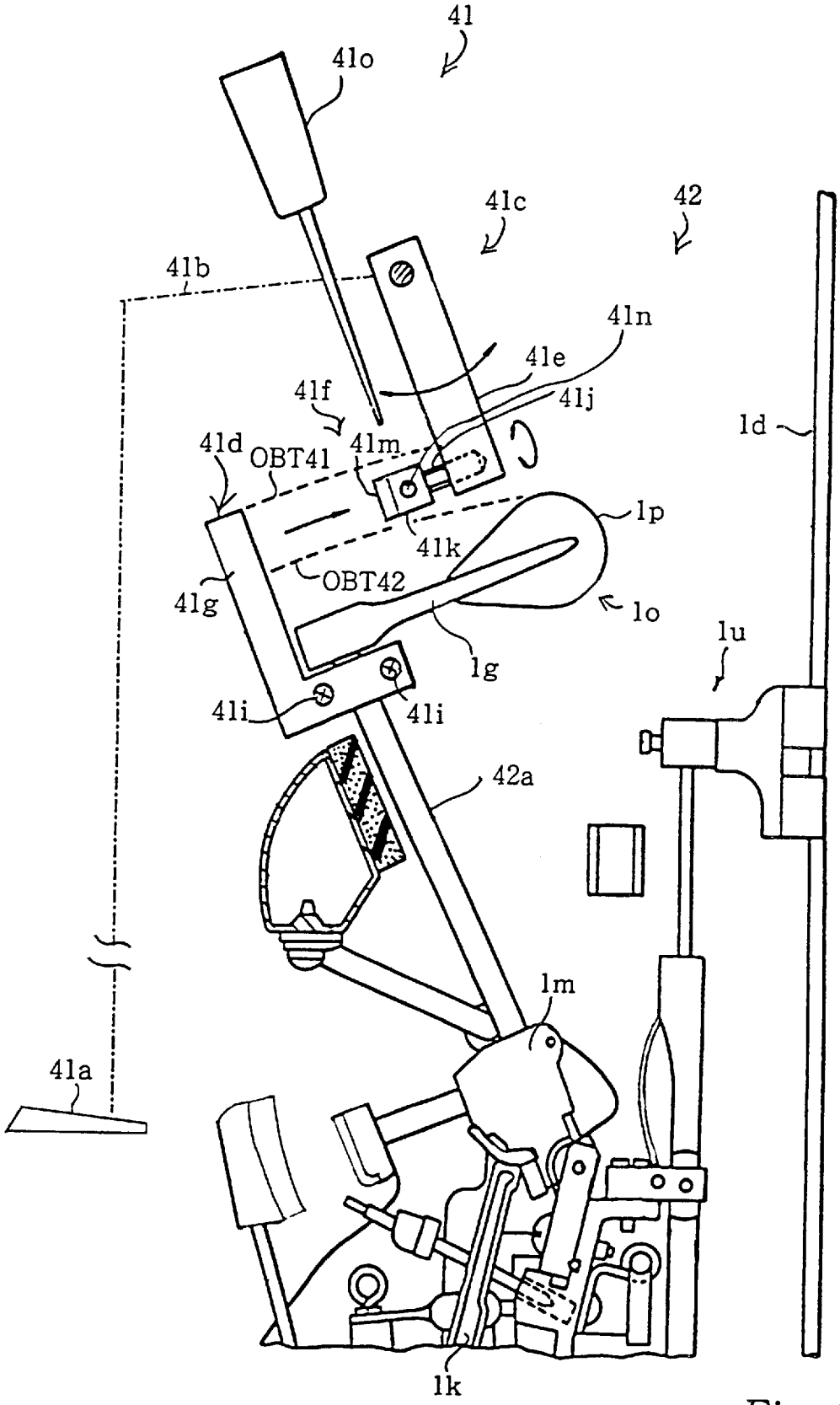
FIG. 9 is a side view showing a silent system incorporated in a keyboard instrument according to the present invention.

Turning to FIG. 9 of the drawings, a silent system 41 is incorporated in another keyboard instrument embodying the present invention. The keyboard instrument implementing the fifth embodiment largely comprises the silent system 41, an acoustic piano 42 and an electronic sound generating system (not shown), and selectively enters into a mechanical sound producing mode and an electronic sound producing mode.

The acoustic piano 42 is of the upright type, and is similar to the acoustic piano 1 except for hammer shanks 42*a*. For this reason, the other component parts are labeled with the references designating the corresponding parts of the acoustic piano 1 without detailed description. In this instance, the hammer shanks 42*a* are inserted into the hammer woods 1*q* as similar to the second embodiment.

The electronic sound generating system is similar to that of the first embodiment, and no further description is incorporated hereinbelow for the sake of simplicity.

The silent system 41 largely comprises a pedal 41*a*, a link mechanism 41*b* and a hammer stopper 41*c*. The pedal 41*a* is manipulated by a player, and is caught by a step portion of a board (not shown) incorporated in the acoustic piano 42 for keeping at manipulated state. The link mechanism 41*b* is connected between the pedal 41*a* and the hammer stopper 41*c*, and causes the hammer stopper 41*c* to change the position.

Namely, while the pedal 41*a* is in the manipulated state, the link mechanism 41*b* changes the hammer stopper 41*c* from a free position to a blocking position, and the hammer stopper 41*c* blocks the strings from the hammer heads 1*o* as will be described in detail below.

On the other hand, when the pedal 41*a* is released from the manipulated position, the link mechanism 41*b* allows the hammer stopper 41*c* to return from the blocking position to the free position, and the hammer heads 1*o* strike the associated strings 1*d* without interruption of the hammer stopper 41*c*.

The hammer stopper 41*c* comprises a plurality of detachable bracket members 41*d* fixed to the hammer shanks 42*a*, a stopper rail 41*e* connected with the link mechanism 41*b* and a plurality of stoppers 41*f* supported by the stopper rail 41*e*.

Figure 10:
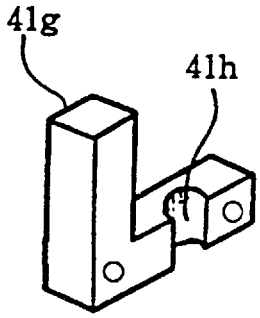
FIG. 10 is a perspective view showing a part of a detachable bracket member of the silent system.
Figure 11:
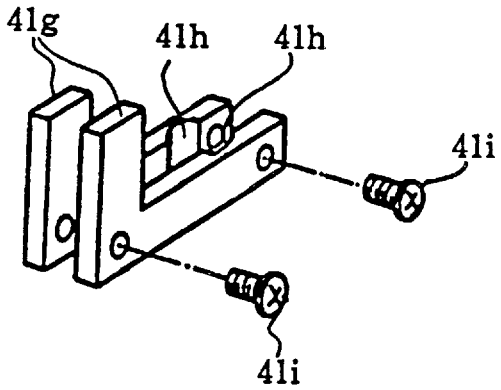
FIG. 11 is a perspective view showing the detachable bracket member in disassembled state.

Each of the detachable bracket members 41*d* is implemented by a pair of generally L-shaped brackets 41*g*, and a recess 41*h* is formed in each of the generally L-shaped brackets 4l*g* as shown in FIG. 10. Each of the hammer shanks 42*a* is sandwiched between the pair of generally L-shaped brackets 41*g*, and bolts 41*i* and nuts (not shown) fix the generally L-shaped brackets 41*g* to a leading end portion of the hammer shank 42*a*. As a result, the detachable bracket members 41*d* radially outwardly project from the hammer woods 1*q*, and respectively trace orbits OBT41 while the hammer heads 1*o* rotate toward the strings 1*d* along the orbits OBT42. There is the blocking position of the hammer stopper 41*c* between the orbits OBT42 of the hammer heads 1*o* and the orbits OBT41 of the detachable bracket members 41*d*. On the other hand, the free position of the hammer stopper 41*d* is out of the orbits OBT41, and not only the hammer mechanisms 1*c* but also the detachable bracket members 41*d* are not brought into contact with the stoppers 41*f*.

Each of the stoppers 41*f* comprises a threaded stem portion 41*j* engaged with a female screw formed in the stopper rail 41*e*, a head portion 41*k* integral with the threaded stem portion 41*j* and a cushion member 41*m* attached to the head portion 41*k*. A hole 41*n* is formed in the head portion 41*k*, and the threaded stem portion 41*j* is turnable by means of a tool 41*o* inserted into the hole 41*n*, thereby regulating the distance between the detachable bracket members 41*d* and the cushion members 41*m* to predetermined values as similar manner to the first embodiment. In this instance, the silent system 11 serves as a controlling system, and the detachable bracket members 41*d* as extensions.

The behavior of the keyboard instrument implementing the fifth embodiment is similar in both mechanical and electronic sound producing modes to the first embodiment, and the remodeling work is analogous to the second embodiment. For this reason, description on the behavior and the remodeling work are omitted for avoiding repetition.

As will be appreciated from the foregoing description, hammer stopper according to the present invention blocks the strings from the hammer heads without sacrifice of the key-touch, and pianos are easily remodeled into the keyboard instrument according to the present invention by using the extensions.

Figure 12A:
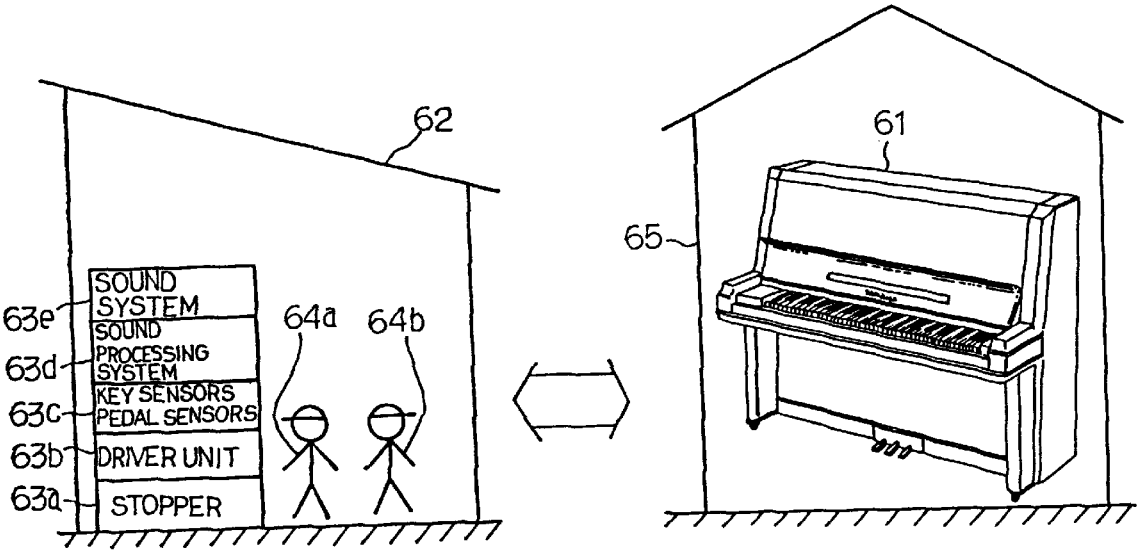
FIGS. 12A and 12B are schematic views showing a method of remodeling an acoustic piano into the keyboard musical instrument according to the present invention.
Figure 12B:
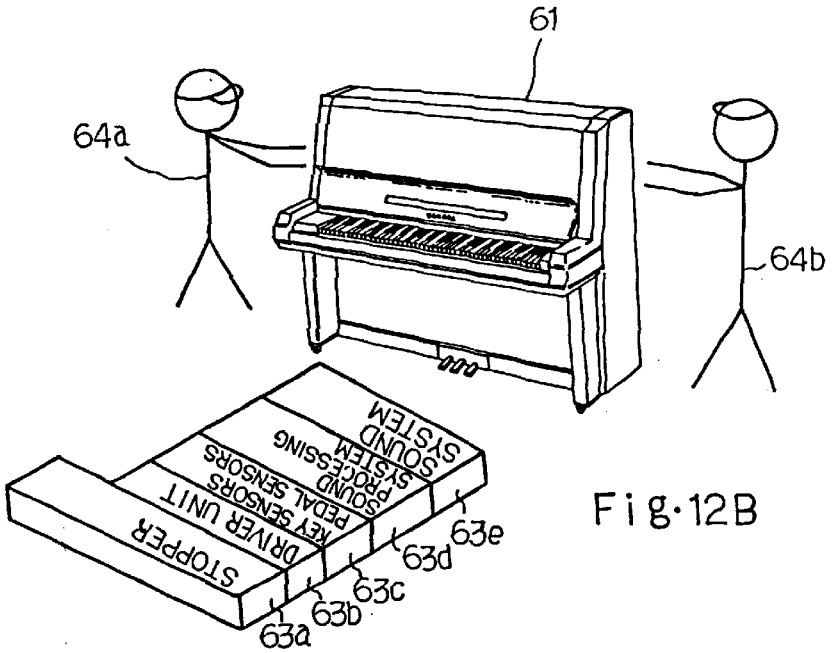

As described hereinbefore, an acoustic piano of the upright type or the grand type is remodeled in the keyboard musical instrument according to the present invention. FIGS. 12A and 12B illustrate a remodeling method according to the present invention. Assuming now that a player wants to remodel an upright piano 61 into the keyboard musical instrument having at least the mechanical and electronic sound producing modes, he or she calls a factory 62 for requesting the remodel.

The factory 62 prepares necessary parts such as a stopper 63*a*, a driver unit 63*b*, key sensors and pedal sensors 63*c*, a sound processing system 63*d* and a sound system 63*e*. When the parts are prepared, the factory 62 sends workers 64*a* and 64*b* to the customer's house 65 together with the necessary parts 63*a* to 63*e*, or the upright piano 61 is transferred to the factory 62.

In either place, the workers 64*a* and 64*b* install the necessary parts 63*a* to 63*e* in the upright piano 61 as shown in FIG. 12B, and the upright piano 61 is remodeled into the keyboard musical instrument.

Figure 13A:
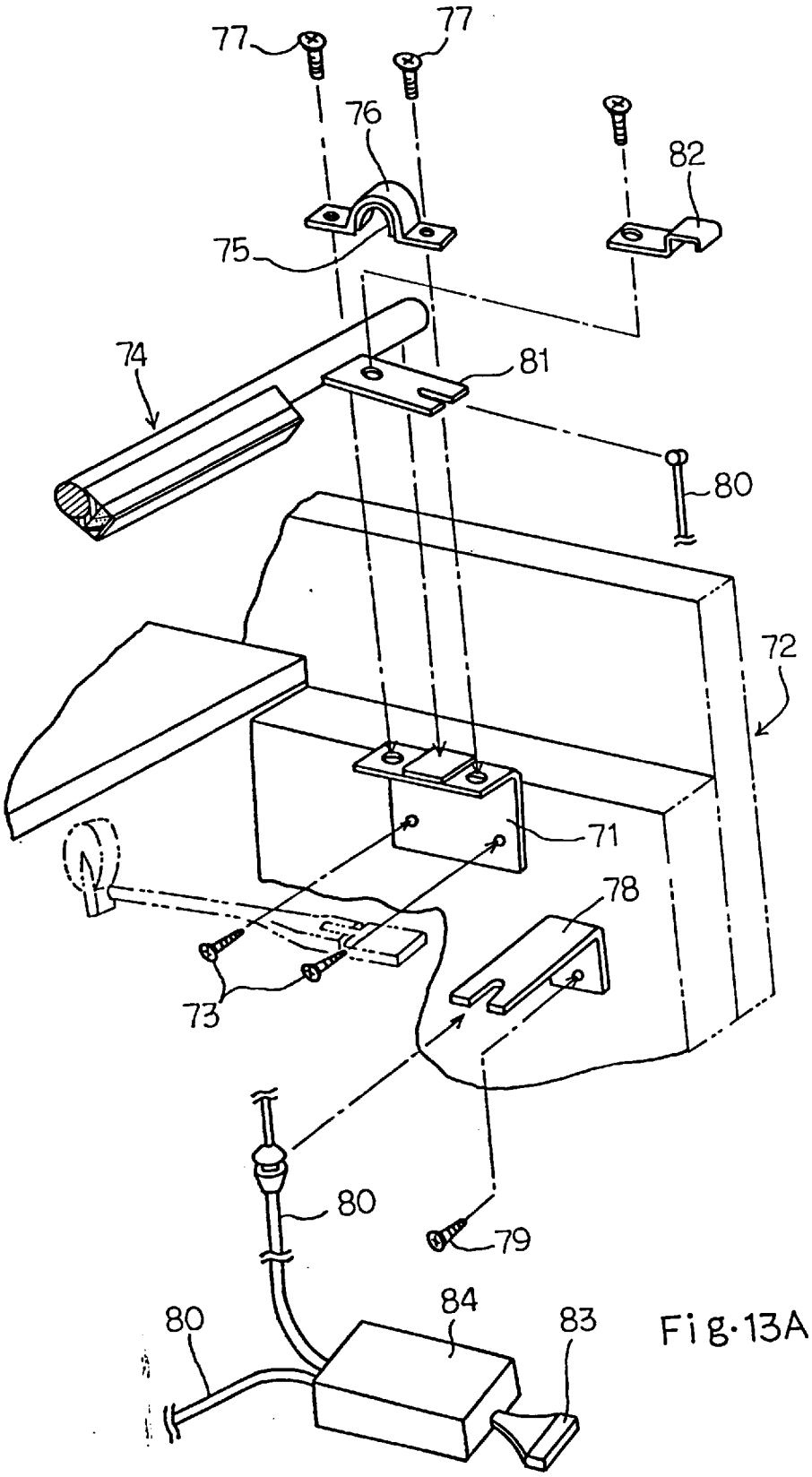
FIGS. 13A and 13B are perspective views showing a remodeling work.
Figure 13B:
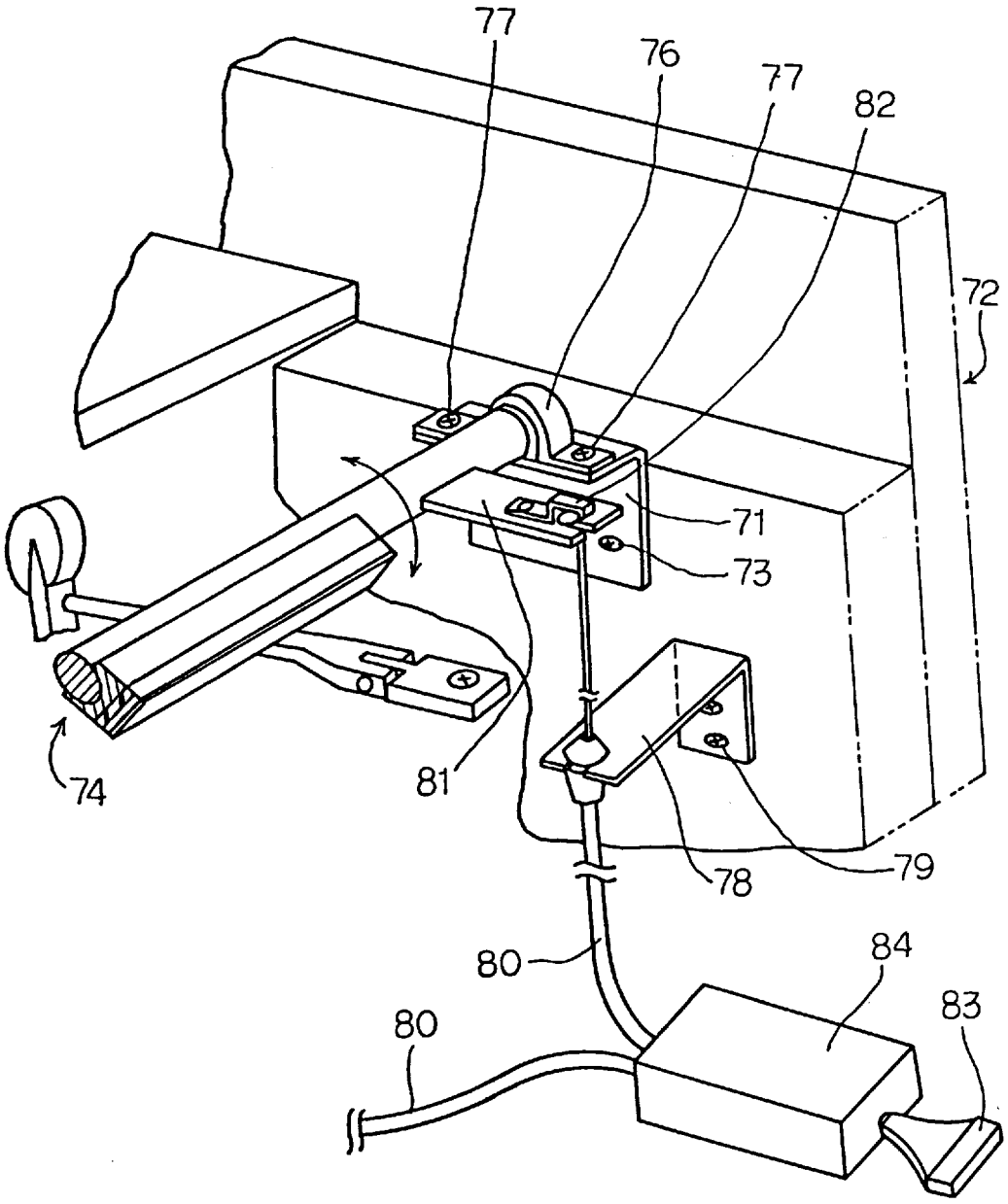
Figure 14:
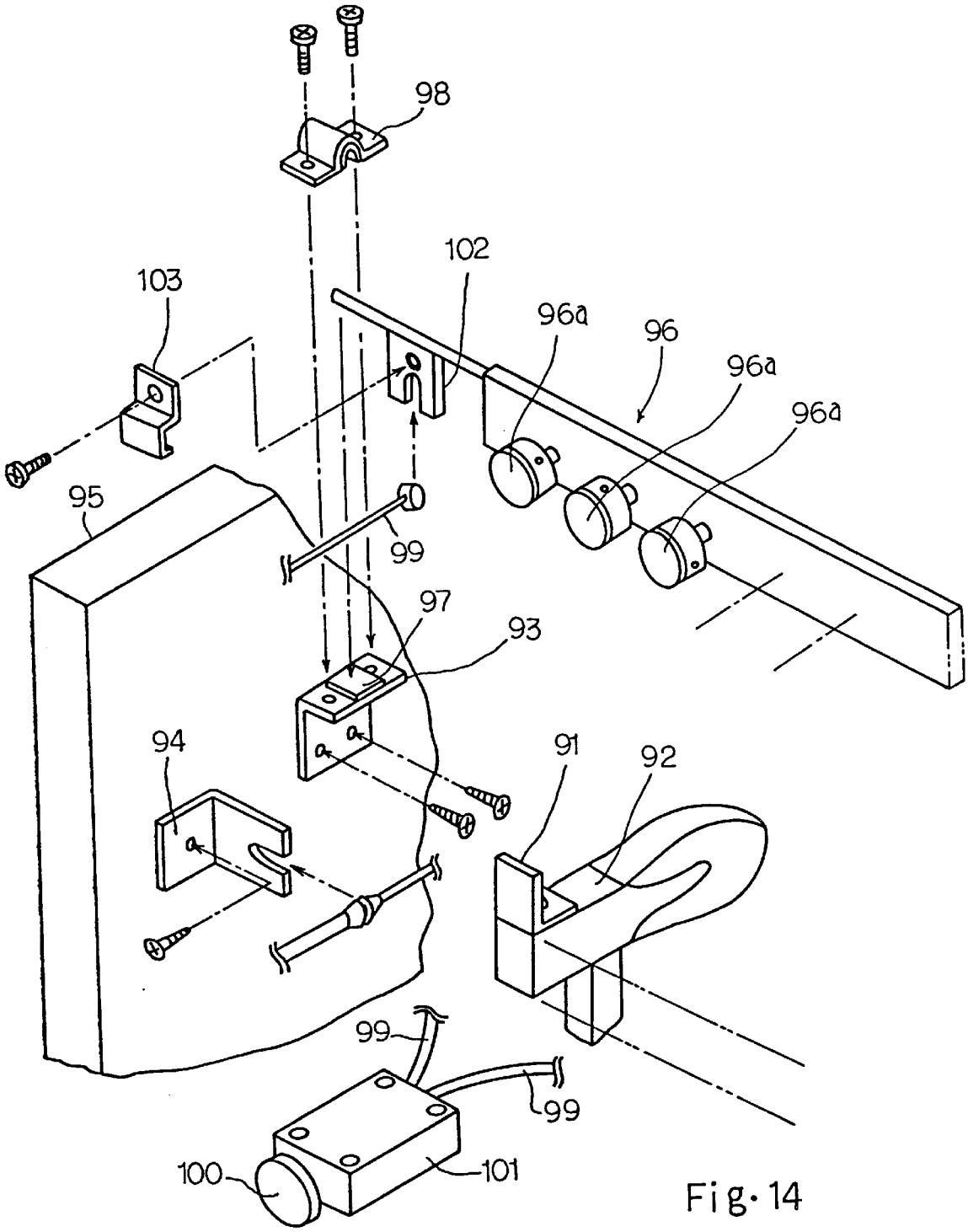
FIG. 14 is a perspective view showing another remodeling work.

If a player requests the workers 64*a* and 64*b* to remodel a grand piano into the keyboard musical instrument, the workers 64*a* and 64*b* fix brackets 71 to inner surfaces of side boards by means of screws 73 (see FIG. 13A), then mounting a stopper 74 on the bracket members 71, finally pressing soft cushion members 75 bonded to inner surfaces of bracket members 76 to the bracket members 71 by means of bolts 77 for rotatably supporting the stopper 74.

The workers 64*a* and 64*b* attached bracket members 78 to the side boards 72 by means of screws 79, and engage flexible cords 80 with the bifurcated portions of the bracket members 78. The leading ends of the flexible cords 80 are engaged with bifurcated projections 81 fixed to the stopper 74, and bracket members 82 are bolted to the bifurcated projections 81 for preventing the leading ends of the flexible cords from separation therefrom. The flexible cord is implemented by a flexible line slidably inserted into a flexible tube.

The flexible cords 80 are terminated at a grip 83 slidable with respect to a box 84, and the box 84 is attached to a suitable board member of the grand piano such as, for example, a lower surface of a key bed (not shown). The brackets 71, 76, 78, 81 and 82, the screws/bolts 73, 77 and 79, the flexible cords 80, the grip 83 and the box 84 as a whole constitute a driver unit. Thus, the stopper 74 and the driver unit are installed in the grand piano through the installation work.

If the piano is of the upright piano, the workers 64*a* and 64*b* attach extensions 91 to the respective hammer heads 92, and fix brackets 93 and 94 to side boards 95 of the upright piano. A stopper 96 is rotatably supported on cushion members 97 by fastening brackets 98 to the brackets 93 in such a manner as to allow the extensions 91 to be brought into contact with cushion members 96*a* of the stopper 96. Flexible cords 99 are terminated at a grip 100 slidable with respect to a box 101, and the leading ends of the flexible cords 99 are engaged with bifurcated members 102 fixed to the stopper 96. Brackets 103 prevent the leading ends of the flexible cords 99 from separation therefrom. The box 101 is attached to an appropriate board member of the upright piano such as a lower surface of the key bed. Thus, the brackets 93, 94, 98, 102 and 103, the flexible cords 99, the grip 100 and the box 101 as a whole constitute a driver unit, and the driver unit and the stopper 96 are installed in the upright piano during the installation work.

Figure 15:
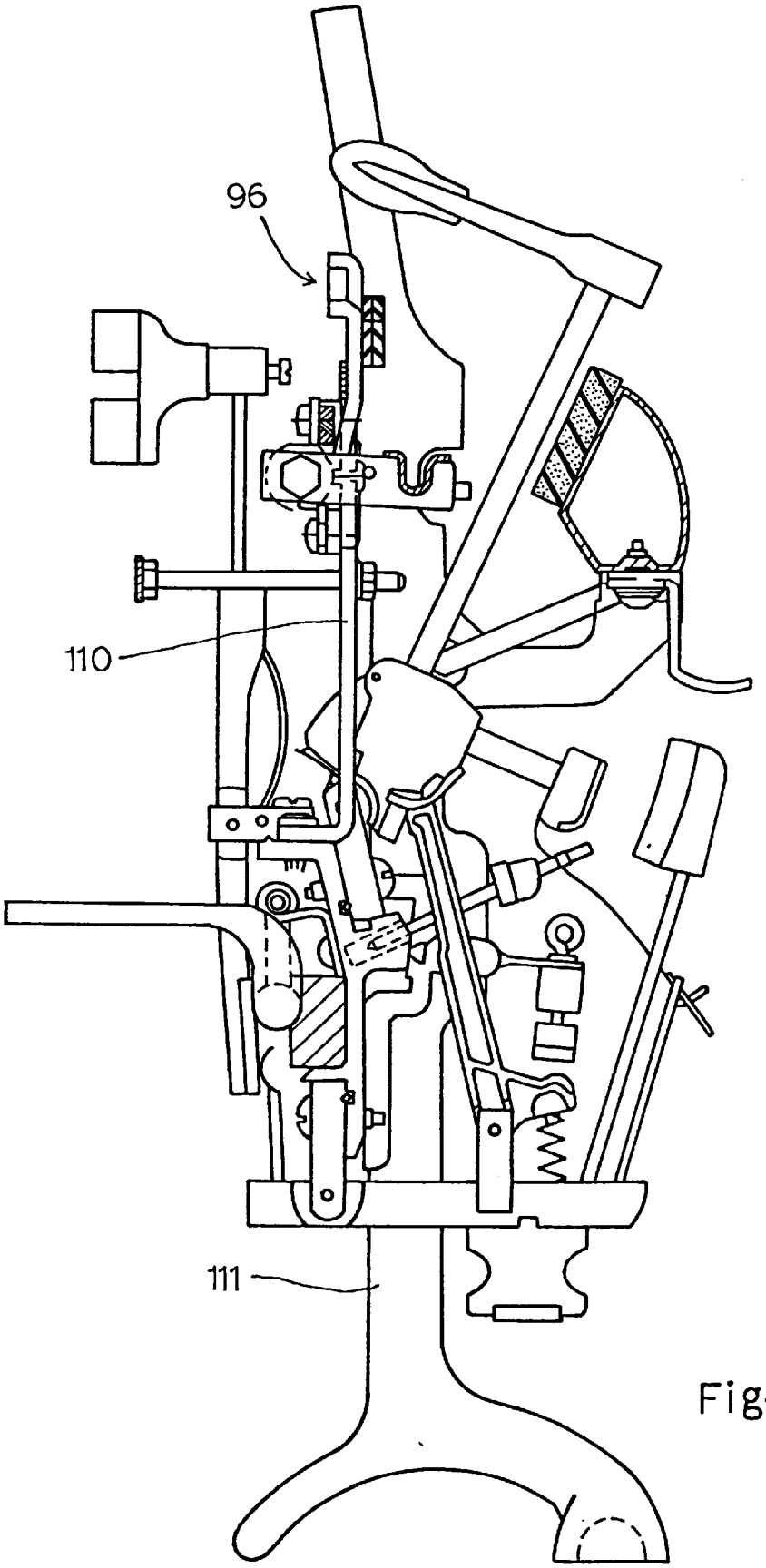
FIG. 15 is a side view showing a stopper attached to action brackets.

In the upright piano described hereinbefore, the stopper 96 is rotatably supported by the side boards 95. However, the stopper 96 may be supported through brackets 110 by action brackets 111 as shown in FIG. 15. Holes are usually drilled in the action brackets 111, and are tapped for bolting brackets. Using the brackets, the stopper 96 may rotatably or swingably be supported by the action brackets 111.

While the workers 64*a* and 64*b* are installing the driver unit and the stopper in the piano, the key sensors and the pedal sensors 63*c* are provided under the keyboard and in the vicinity of the pedals, and the sound system 63*e* is installed in the piano. If the sound system 63*e* is implemented by a headphone only, a suitable socket is exposed to a surface of a board member. The sound processing system 63*d* is further attached to an inner surface of a board member of the piano, and is connected to the key and pedal sensors 63*c* and the sound system 63*e*.

In the above described examples, both key and pedal sensors 63*c* are installed in the piano. However, only the key sensors may be installed in the remodeling work.

As will be appreciated from the foregoing description, an acoustic piano is remodeled into the keyboard musical instrument through the method according to the present invention, and a family that already had a piano economically acquires the keyboard musical instrument having at least the mechanical sound producing mode and the electronic sound producing mode.

Although particular embodiments of the present invention have been shown and described, it will be obvious to those skilled in the art that various changes and modifications may be made without departing from the spirit and scope of the present invention. For example, the link mechanism 2*c* may be manipulated by a hand of the player, and the rotatable stopper 2*b* may be shifted by an electric motor or a solenoid-operated actuator. Moreover, each of the stoppers 2*e* may be shared between several hammer mechanisms, and a grand piano is available as the acoustic piano.

What is claimed is:

1. A method of retrofitting an existing piano into a keyboard instrument having at least a mechanical sound producing mode and an electronic sound producing mode, said piano having side boards, a plurality of keys, a plurality of hammer mechanisms each comprising a hammer shank and a hammer head attached to one end thereof, and a plurality of sets of strings associated with said plurality of hammer mechanisms, said method of retrofitting comprising the steps of:

a. installing a controlling system into said piano comprising the steps of:

attaching detachable first brackets to respective said hammer heads, installing a hammer stopper into said piano by fixing second brackets to inner surfaces of said side boards of said piano, mounting said hammer stopper on said second brackets, and pressing soft cushion members bonded to inner surfaces of bracket holding members to said second brackets for rotatably supporting said hammer stopper in such a manner as to allow said first brackets to be brought into contact with cushion members of said hammer stopper; and installing a driver unit into said piano by attaching third brackets to said side boards, and engaging flexible cords with said third brackets, said flexible cords being also engaged with projections fixed to said stopper; and b. installing an electronic sound producing system into said piano by attaching a sound processing sub-system of said electronic sound producing system to an inner surface of a board member of said piano and connecting said sound processing sub-system to a plurality of sensors operative to detect said keys of said piano when a player depresses said keys and operative to produce audio signals for generating sound, and connecting to said sound processing sub-system a sound producing sub-system of said electronic sound producing system operative to produce sounds.

2. The method as set forth in claim 1, wherein said step of installing said controlling system further comprises the step of:

providing a pedal to be manipulated by a player, said pedal when at a manipulated state moving said stopper from a free position to a blocking position and when said pedal is released from the manipulated state moving said stopper from the blocking position to a free position.

3. The method as recited in claim 1, wherein said hammer stopper further comprises said plurality of first brackets coupled to said hammer heads, a stopper rail, and a plurality of stoppers supported by said stopper, and said step of installing said hammer stopper further comprises locating said hammer stopper along a trajectory of said hammer mechanisms while in said blocking position so as to block said first brackets and prevent said plurality of hammer assemblies from striking said plurality of sets of strings, and locating said stopper out of said trajectory while in said free position so as to not block said first brackets.

4. The method as recited in claim 1, wherein said hammer mechanisms are driven for rotation, and said step of installing said hammer stopper further comprises locating said hammer stopper such that said hammer stopper is installed in such a manner that said hammer mechanisms rebound off said hammer stopper while said hammer stopper is in said blocking position.

5. The method as recited in claim 1, wherein said piano includes board members, and said step of installing said hammer stopper further comprises disposing said hammer stopper such that said hammer stopper is rotatably supported by said board members so that said driver unit moves said stopper between said free position and said blocking position through a rotation of said stopper, and when said hammer mechanisms are driven for rotation, said hammer mechanisms rebound off said stopper while said stopper is in said blocking position.

6. The method as recited in claim 1, wherein said piano includes action brackets, and said step of installing said hammer stopper further comprises disposing said hammer stopper such that said hammer stopper is rotatably supported by said action brackets so that said driver unit moves said hammer stopper between said free position and said blocking position through a rotation of said hammer stopper, and when said hammer mechanisms are driven for rotation, said hammer mechanisms rebound off said hammer stopper while said hammer stopper is in said blocking position.

7. A method of retrofitting an existing piano into a keyboard instrument for selectively entering into at least a mechanical sound producing mode and an electronic sound producing mode, said piano having side boards, a plurality of keys, a plurality of hammer mechanisms, and a plurality of sets of strings associated with said plurality of hammer mechanisms, said method comprising the steps of:

installing a controlling system into said piano comprising the steps of:

attaching extensions to respective hammer heads of said piano, installing a movable stopper into said piano by fixing first brackets to inner surfaces of said side boards, mounting said movable stopper on said first brackets for rotatably supporting said movable stopper in such a manner as to allow said extensions to be brought into contact with said movable stopper; and installing a driver unit into said piano by attaching second brackets to said side boards, and engaging flexible cords with said second brackets, said flexible cords being also engaged with projections fixed to said movable stopper; and installing an electronic sound producing system into said piano by attaching a sound processing sub-system to an inner surface of a board member of said piano, said sound processing sub-system being connected to a plurality of sensors operative to detect said keys of said piano when a player depresses said keys and operative to produce audio signals for generating sound, and connecting to said sound processing sub-system a sound producing sub-system operative to produce sounds.

* * * * *